United States Patent [19]

Miller

[11] Patent Number: 4,874,126

[45] Date of Patent: Oct. 17, 1989

[54] CONTAINER OPENING DEVICE

[76] Inventor: Lawrence G. Miller, 5615 Barna Ave., Titusville, Fla. 32780

[21] Appl. No.: 329,966

[22] Filed: Mar. 29, 1989

[51] Int. Cl.[4] ..... B65D 5/44

[52] U.S. Cl. ..... 229/160.2; 206/628; 206/631.3; 206/633

[58] Field of Search ..... 229/160.2, 125.42; 206/621.1, 621.2, 628, 633, 631.3, 616, 617, 613

[56] References Cited

U.S. PATENT DOCUMENTS

| | | | |
|---|---|---|---|
| 1,463,443 | 7/1923 | Fayers et al. | 220/279 |
| 2,149,308 | 3/1939 | Peckham | 220/279 |
| 2,239,691 | 4/1941 | Becker | 220/279 |
| 2,353,746 | 7/1944 | Moore | 206/617 |
| 2,546,052 | 3/1951 | Wilkins | 229/160.2 |
| 2,640,623 | 6/1953 | Ryder | 220/279 |
| 3,520,464 | 7/1970 | Pugh, Sr. | 229/160.2 |
| 3,567,108 | 3/1971 | Corridon | 206/613 |
| 4,126,245 | 11/1978 | Baroody | 220/279 |
| 4,634,008 | 1/1987 | Ströbe et al. | 206/628 |
| 4,821,950 | 4/1989 | Sanchez et al. | 206/628 |

FOREIGN PATENT DOCUMENTS

| | | | |
|---|---|---|---|
| 2650092 | 5/1978 | Fed. Rep. of Germany | 206/616 |
| 2734250 | 2/1979 | Fed. Rep. of Germany | 206/617 |
| 8203370 | 10/1982 | PCT Int'l Appl. | 206/631.3 |

*Primary Examiner*—Gary Elkins

*Attorney, Agent, or Firm*—Jerry T. Kearns

[57] ABSTRACT

A container opening device is designed for use with waxed paper board cartons of the type utilized for packaging milk, orange juice and other beverages. These cartons have an initially closed dispensing opening formed by a pair of overfolded flaps intersecting at a central apex. The present invention includes a manual grasping element secured by a cord to the central apex to facilitate opening of the carton. The manual grasping member may comprise a ring for finger insertion or a small spherical ball. The cord is secured to a reinforcement strip which may be adhesively secured to an exterior surface of the cart or sandwiched between the paper board layers forming the carton.

8 Claims, 4 Drawing Sheets

CONTAINER OPENING DEVICE

BACKGROUND OF THE INVENTION

1. Field of the Invention

The present invention relates to container opening devices, and more particularly pertains to an opening device for facilitating the opening of the conventional form of carton utilized to package milk and other beverages. This conventional type of carton has an initially closed dispensing opening formed by a pair of overfolded flaps which intersect at a central apex. These flaps are then bonded to seal the carton contents. Opening of these cartons can be a frustating task which frequently results in damage to the carton flaps which destroys the pouring spout and prevents proper reclosure. In order to overcome this problem, the present invention utilizes a manual grasping element secured by a cord to the central folded apex of the flaps.

2. Description of the Prior Art

Various types of container opening devices are known in the prior art. A typical example of such a container opening device is to be found in U.S. Pat. No. 1,463,443, which issued to W. Fayers et al on July 31, 1923. This patent discloses a sealed metal container having a removable lid adapted to be opened by manual pulling of a grasping element. The grasping element is in the form of a metal ring secured by a cord to the circular container cover. U.S. Pat. No. 2,149,308, which issued to J. Peckham on Mar. 7, 1939, discloses a container opening arrangement for removing a metal top from a cylindrical container formed as a peripheral wire terminating in a finger insertion ring. U.S. Pat. No. 2,239,692, which issued to R. Becker on Apr. 29, 1941, discloses a cylindrical milk package having an opening spout including a pull tab portion formed on a top surface of the package. U.S. Pat. No. 2,640,623, which issued to I. Ryder on June 2, 1953, discloses a compartmentalized container having a peripheral opening cord terminating in a finger engagement ring. U.S. Pat. No. 4,126,245, which issued to J. Baroody on Nov. 21, 1978, discloses a seal for the closure of a cylindrical container which includes a tear string or tab for disengaging the seal.

While the above mentioned devices are directed to container opening devices, none of these devices disclose a manual grasping element secured by a cord to a reinforcement strip extending across the apex of intersection of the overfolded flaps forming an initially closed dispensing opening on awaxed paper carton type container. Additional features of the present invention, not contemplated by the aforesaid devices include the provision of a rigid reinforcement strip at the apex extending across the overfolded flaps of a carton type beverage container. Inasmuch as the art is relatively crowded with respect to these various types of container opening devices, it can be appreciated that there is a continuing need for and interest in improvements to such container opening devices, and in this respect, the present invention addresses this need and interest.

SUMMARY OF THE INVENTION

In view of the foregoing disadvantages inherent in the known types of container opening devices now present in the prior art, the present invention provides an improved container opening device. As such, the general purpose of the present invention, which will be described subsequently in greater detail, is to provide a new and improved container opening device which has all the advantages of the prior art container opening devices and none of the disadvantages.

To attain this, representative embodiments of the concepts of the present invention are illustrated in the drawings which make use of a container opening device designed for use with waxed paper board cartons of the type utilized for packaging milk, orange juice and other beverages. These cartons have an initially closed dispensing opening formed by a pair of overfolded flaps intersecting at a central apex. A manual grasping element is secured by a cord to the central apex to facilitate opening of the carton. The manual grasping member may comprise a ring for finger insertion or a small spherical ball. The cord is secured to a reinforcement strip which may be adhesively secured to an exterior surface of the cart or sandwiched between the paper board layers forming the carton.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container opening device which has all the advantages of the prior art container opening devices and none of the disadvantages.

It is another object of the present invention to provide a new and improved container opening device which may be easily and efficiently manufactured and marketed.

It is a further object of the present invention to provide a new and improved container opening device which is of a durable and reliable construction.

An even further object of the present invention is to provide a new and improved container opening device which is susceptible of a low cost of manufacture with regard to both materials and labor, and which accordingly is then susceptible of low prices of sale to the consuming public, thereby making such container opening device economically available to the buying public.

Still yet another object of the present invention is to provide a new and improved container opening device which provides in the apparatuses and methods of the prior art some of the advantages thereof, while simultaneously overcoming some of the disadvantages normally associated therewith.

Still another object of the present invention is to provide a new and improved container opening device for facilitating the opening of paper carton type beverage containers.

Yet another object of the present invention is to provide a new and improved container opening device which includes a reinforcing strip for preventing damage to the opening spout area of a paper carton type beverage container.

Even still another object of the present invention is to provide a new and improved container opening device for facilitating the opening of paper carton type beverage containers while simultaneously providing reinforcement for the dispensing spout portion of the carton.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
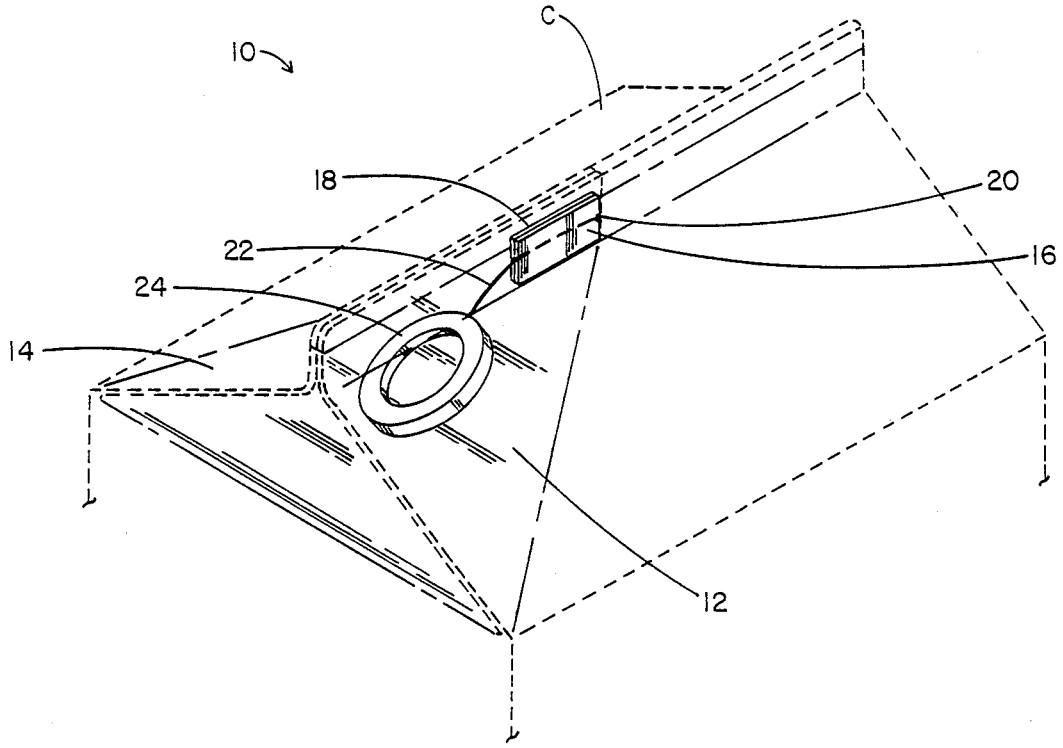
FIG. 1 is a perspective view of a carton including the opening device according to a first embodiment of the present invention, with the dispensing opening of the carton in a closed position.

With reference now to the drawings, and in particular to FIG. 1 thereof, a new and improved container opening device embodying the principles and concepts of the present invention and generally designated by the reference numeral 10 will be described.

More specifically, it will be noted that the first embodiment 10 of the invention includes a conventional waxed paper board carton C of the type utilized to package milk and other beverages. The carton C has an initially closed dispensing opening formed by a pair of overfolded flaps 12 and 14 which are joined at a common apex 20. A semi-rigid strip has halves 16 and 18 joined at a folding central joint at the apex 20 where a cord 22 is also secured. The cord 22 is preferably formed from a high strength synthetic material, such as monafilament nylon. A manual grasping element 24 is secured at an opposite end of the cord 22 to facilitate opening of the carton C.

Figure 2:
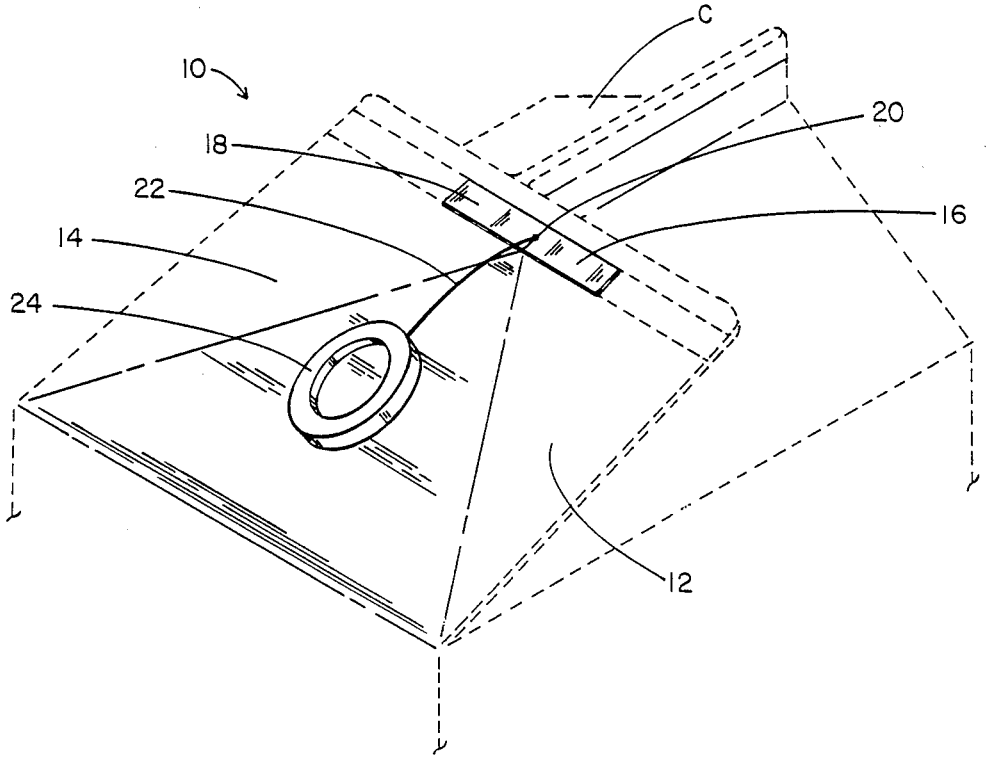
FIG. 2 is a perspective view of the carton of FIG. 1, with the dispensing opening in a partially open position.

FIG. 2 illustrates the carton C after the flaps 12 and 14 have been folded back in the first step of opening the carton dispensing opening. The strip halves 16 and 18 may be formed from a rigid or semi-rigid plastic material having a central folding joint at 20 which may be adhesively secured on the outer surface of the carton C or may be sandwiched between the paper board layers utilized to form the carton itself. The strip may also be formed from a paper board material. The strip halves 16 and 18 may be formed from a plastic material which has a resilient "memory" characteristic which serves to bias the flaps 12 and 14 toward fully opened and closed positions, thus maintaining the dispensing spout in the desired proper orientation. The grasping element 24 may be formed as a plastic ring having a central aperture dimensioned for the insertion of an individual's finger.

Figure 3:
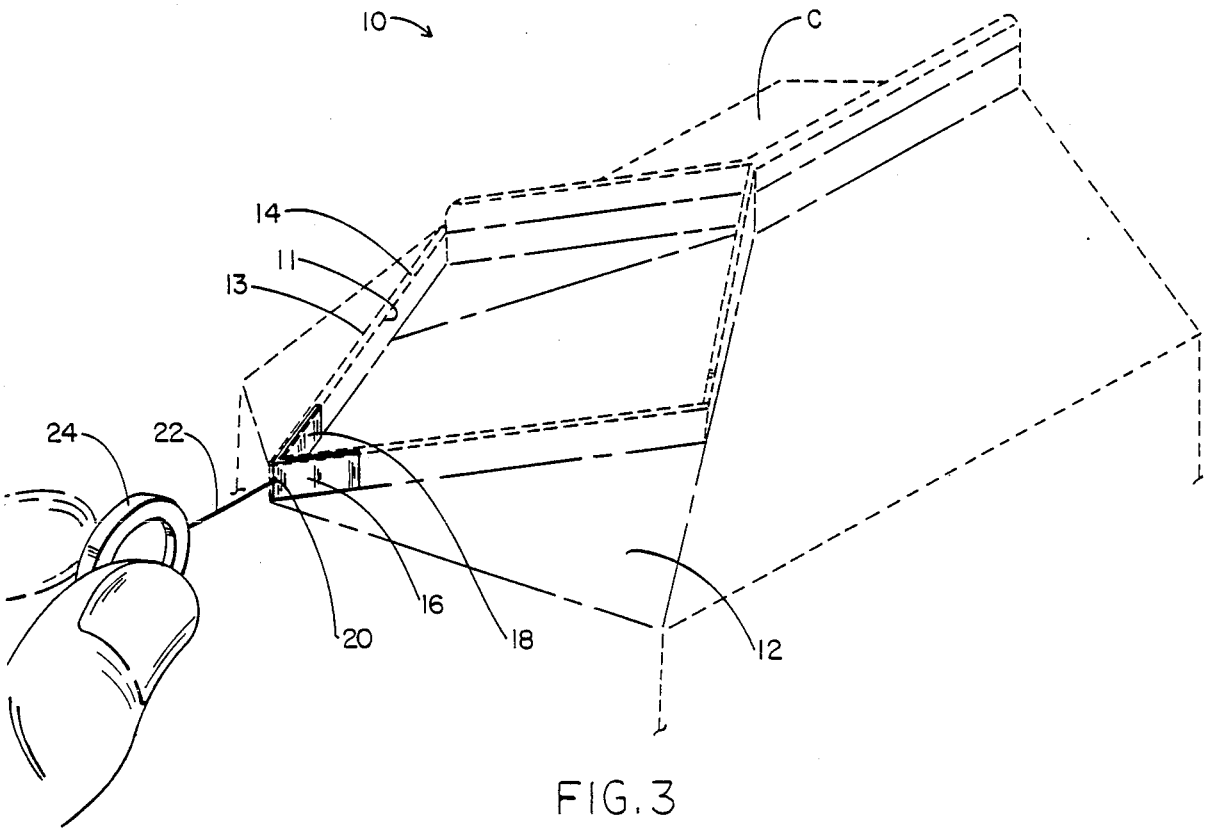
FIG. 3 is a perspective view of the carton of FIG. 1, with the dispensing opening in a fully open position.

As shown in FIG. 3, an individual may open the dispensing opening to an fully open position by pulling the grasping element 24. The strip halves 16 and 18 may be sandwiched between the paper board layers 13 and 14 which form the carton C. The strip forms a reinforcement as well as a securement for the cord 22, which prevents damage to the pouring spout portion of the flaps 12 and 14.

Figure 4:
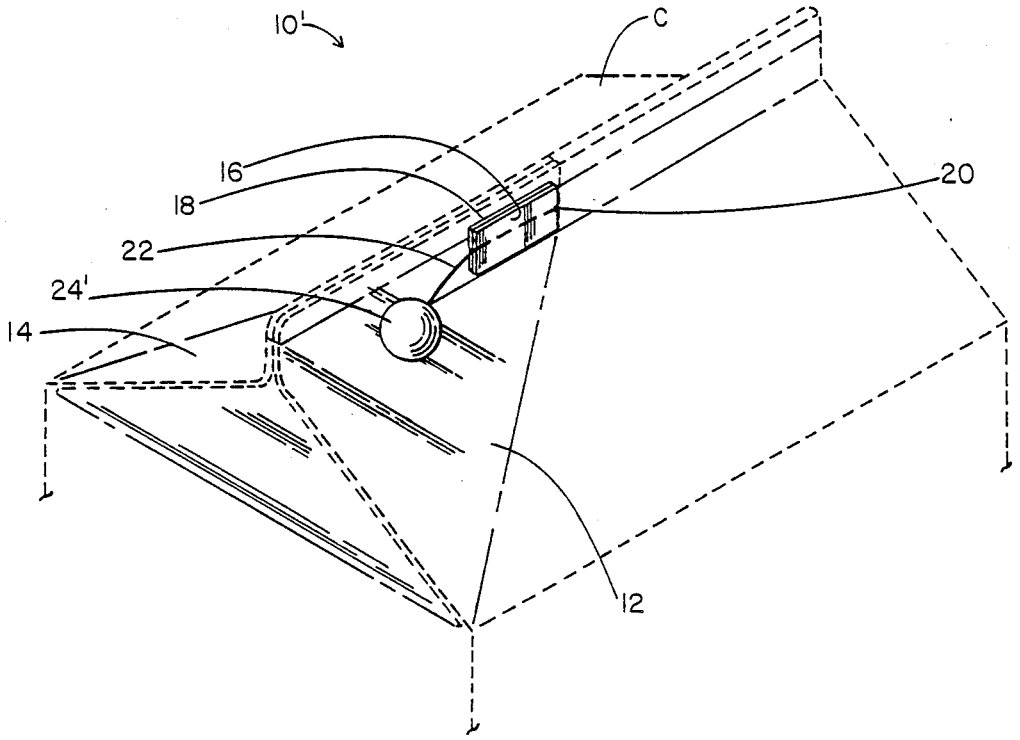
FIG. 4 is a perspective view illustrating a carton utilizing an opening device according to a slightly modified second embodiment of the present invention, with the dispensing opening of the carton in a closed position.

FIG. 4 illustrates an alternative embodiment 10', which is identical to the first embodiment 10, with the exception that the grasping element takes the form of a small spherical ball 24'.

Figure 5:
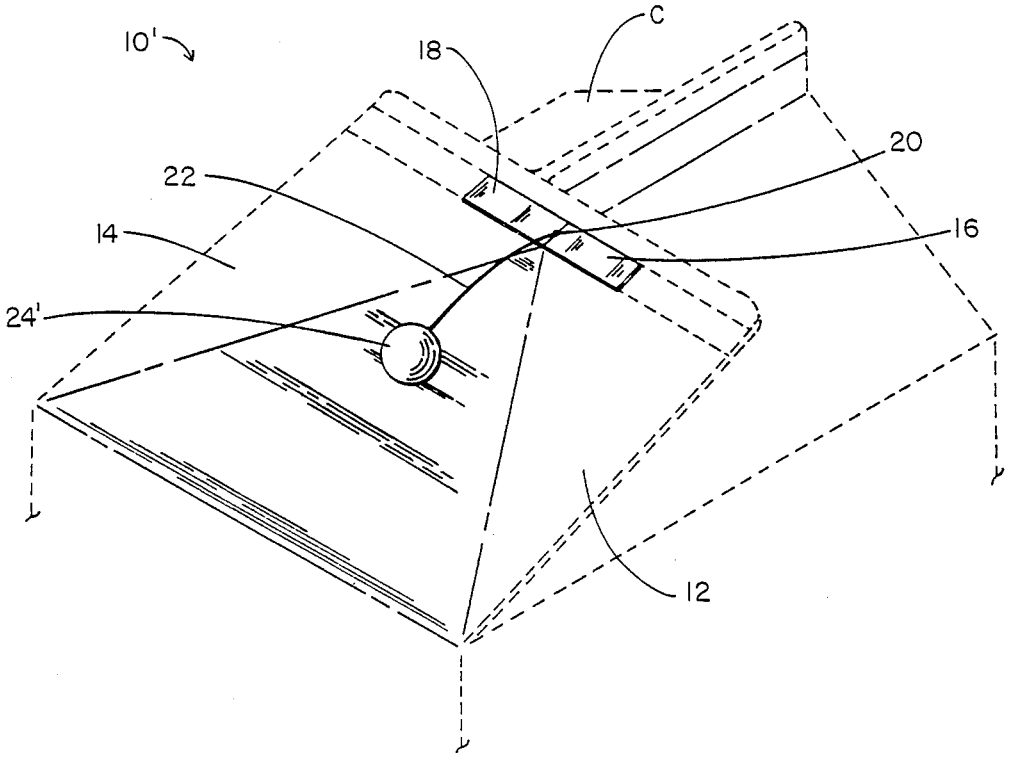
FIG. 5 is a perspective view of the carton of FIG. 4, with the dispensing opening in a partially open position.

FIG. 5 illustrates the carton flaps 12 and 14 folded during the initial opening of the carton C, exposing the grasping ball 24' which preferably takes the form of a small rigid plastic bead.

Figure 6:
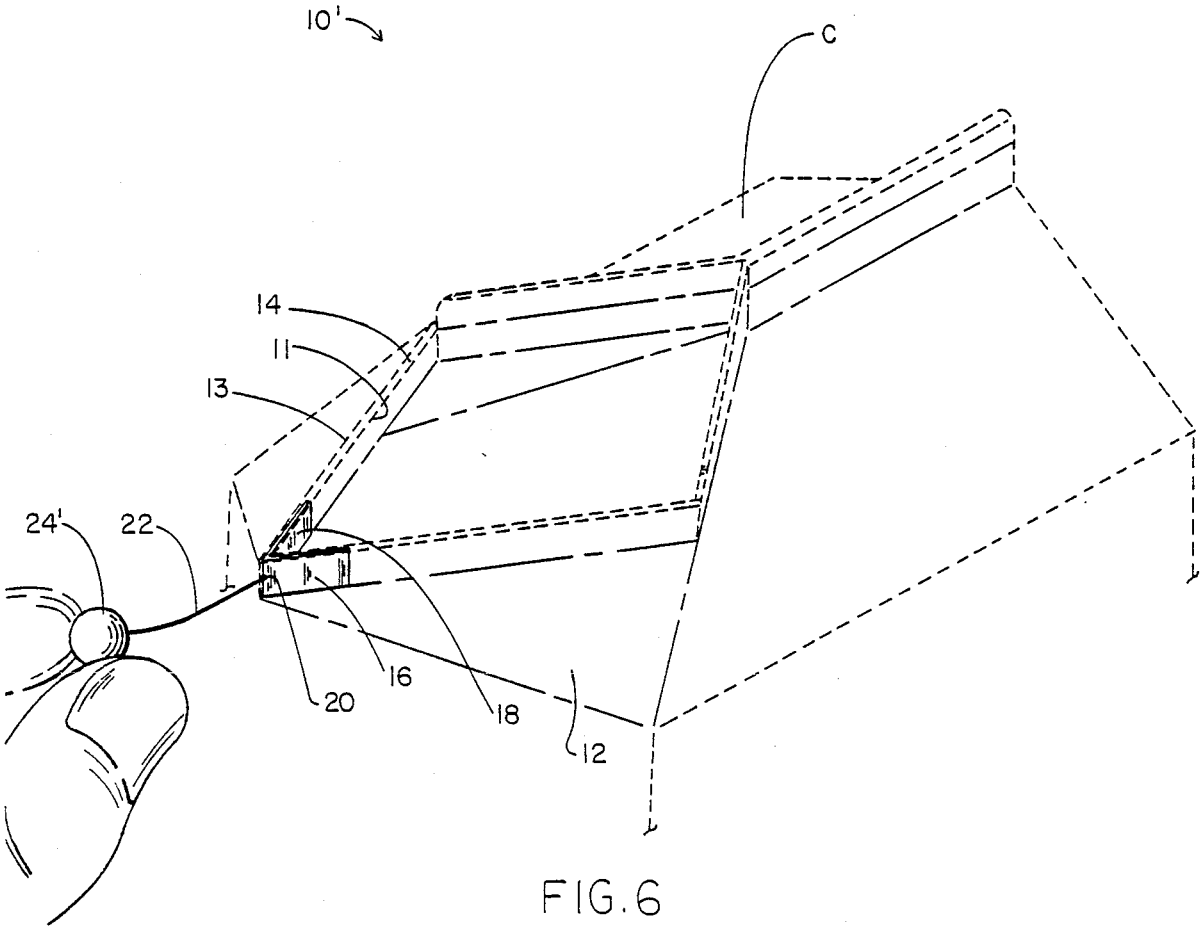
FIG. 6 is a perspective view of the carton of FIG. 4, with the dispensing opening in a fully open position.

FIG. 6 illustrates the use of the grasping bead 24' to fully open the dispensing opening of the carton C.

As may now be understood, the present invention provides an improved opening device for a conventional form of paper board carton of the type utilized to package milk and other beverages. The present invention eliminates damage to the flaps during opening which can prevent a proper reseal of the carton as well as ruin the pouring characteristics of the dispensing spout. The device is particularly helpful for individuals who have limited hand strength because of arthritis or other infirmities.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In a carton formed from a semi-rigid paper board material and having an initially closed dispensing opening formed by a pair of overfolded flaps joined at a central apex, the improvement comprising:

a strip securled to said carton and extending between said flaps and having a central folding joint disposed at said central apex;

a cord having a first end secured at central point of said strip; and grasping means at an opposite end of said cord whereby said dispensing opening may be opened by pulling said grasping means.

2. The container opening device of claim 1, wherein said grasping means comprises a ring.

3. The container opening device of claim 1, wherein said grasping means comprises a ball.

4. The container opening device of claim 1, wherein said strip comprises a rigid plastic material.

5. The container opening device of claim 1, wherein said strip comprises a rigid paper board material.

6. The container opening device of claim 1, wherein said strip comprises a flexible tape adhesively secured to an exterior surface of said carton.

7. The container opening device of claim 1, wherein said strip is sandwiched between two layers forming said carton.

8. The container opening device of claim 1, wherein said strip is formed from a semi-rigid plastic material which provides a biasing force for maintaining said flaps in fully open and fully closed positions.

* * * * *